US005426967A

United States Patent [19]

Sparlin

[11] Patent Number: 5,426,967

[45] Date of Patent: Jun. 27, 1995

[54] APPARATUS AND METHOD FOR FORMING BULLNOSE CORNER BEAD

[76] Inventor: Michael D. Sparlin, P.O. Box 291346, Phelan, Calif. 92329

[21] Appl. No.: 195,155

[22] Filed: Feb. 14, 1994

[51] Int. Cl.[6] ..... B21D 5/16; B21D 17/02

[52] U.S. Cl. ..... 72/414; 72/296; 72/305; 72/387; 29/897.3

[58] Field of Search ..... 72/414, 389, 387, 296, 72/305, 293, 379.2; 29/897.3, 897.31, 897.34

[56] References Cited

U.S. PATENT DOCUMENTS

| | | | |
|---|---|---|---|
| 2,638,958 | 5/1953 | Norquist | 72/305 |
| 3,583,199 | 6/1971 | Speiser | 72/387 |
| 5,311,760 | 5/1994 | Thompson | 72/379.2 |

FOREIGN PATENT DOCUMENTS

| | | | |
|---|---|---|---|
| 1276049 | 10/1961 | France | 72/293 |
| 615740 | 7/1935 | Germany | 72/305 |
| 126323 | 9/1980 | Japan | 72/389 |
| 150051 | 12/1931 | Switzerland | 72/414 |

OTHER PUBLICATIONS

Hamilton Materials Pla-Cor® Model 8590 brochure; Hamilton Materials, Orange, CA; 1 p.; no date.

*Primary Examiner*—Daniel C. Crane
*Attorney, Agent, or Firm*—Sheldon & Mak

[57] ABSTRACT

An portable apparatus for inexpensively forming plain angle ends of bullnose corner beading includes a base; an external die on the base; a pair of retainers for symmetrically holding opposite leg extremities of the corner bead relative to the external die; an internal die pivotally supported relative to the base for movement between open and closed positions for forming the end portion of the corner bead into the plain angular shape; a handle and link mechanism for operating the internal die; and a stop member rigidly located relative to the base for providing a predetermined length of the end portion. The retainers can be adjustable relative to the external die for accommodating corner bead having different flange widths, the retainers being movable symmetrically relative to a dihedral apex of the external die member. In another aspect of the invention, a method for forming the corner bead includes the steps of providing the corner bead having uniform bullnose cross-section; supporting the end portion of the corner bead against an external die; retaining opposite leg extremities of the corner bead in a laterally symmetric position relative to the external die; and driving an internal die into proximity with the exterior die whereby the planar surfaces of the interior die come into closely spaced relation to the external die over a predetermined distance for forming the end portion of the corner bead.

17 Claims, 2 Drawing Sheets

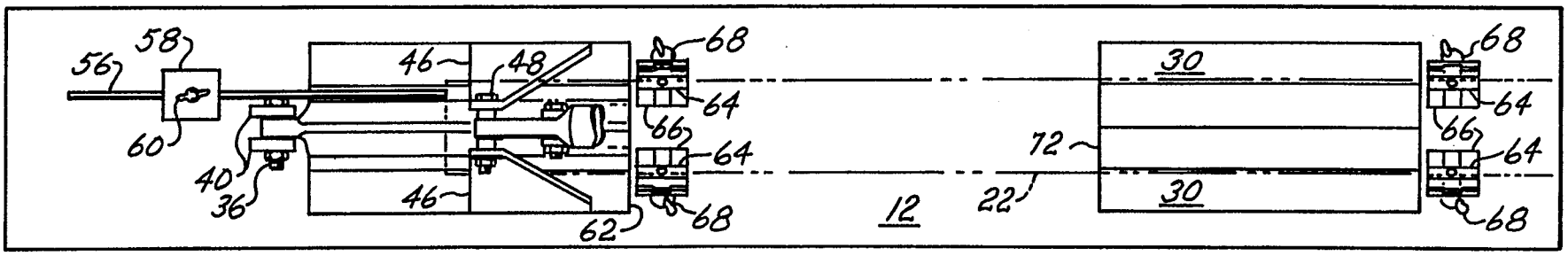
FIG. 2.
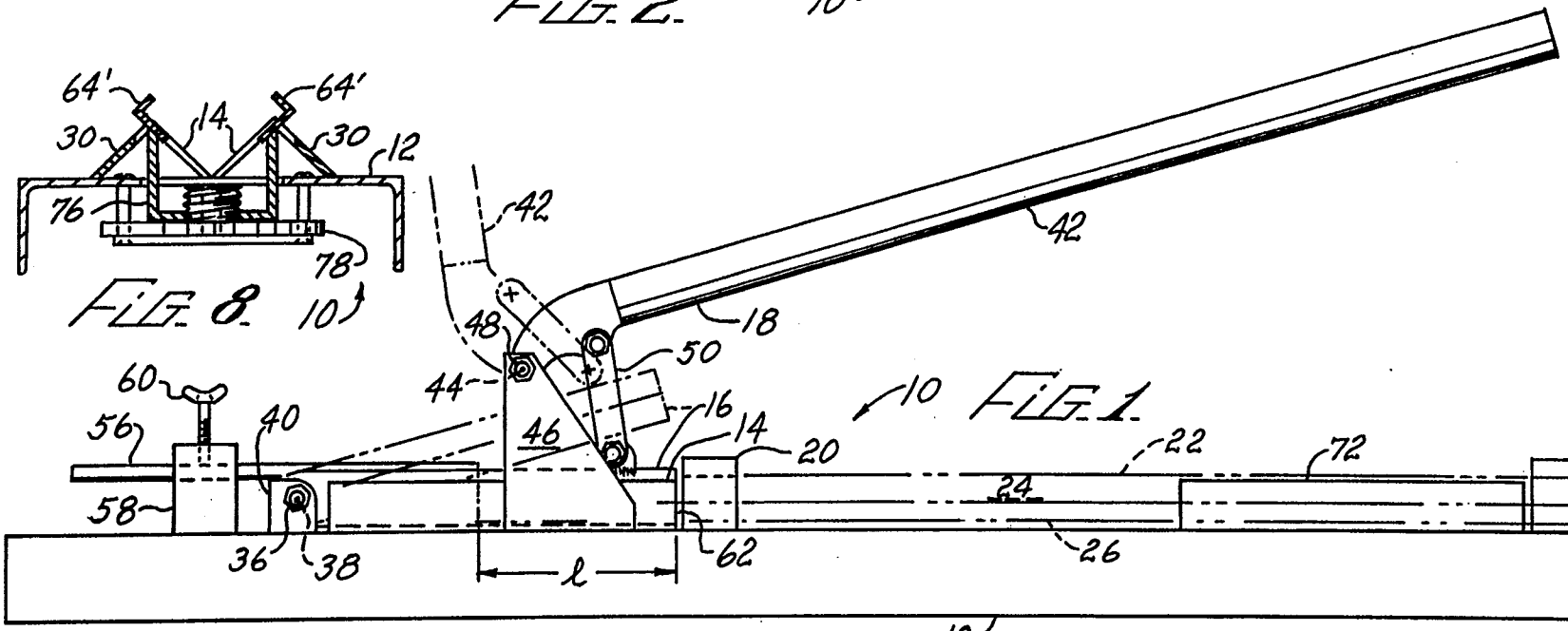
FIG. 1.
FIG. 8.

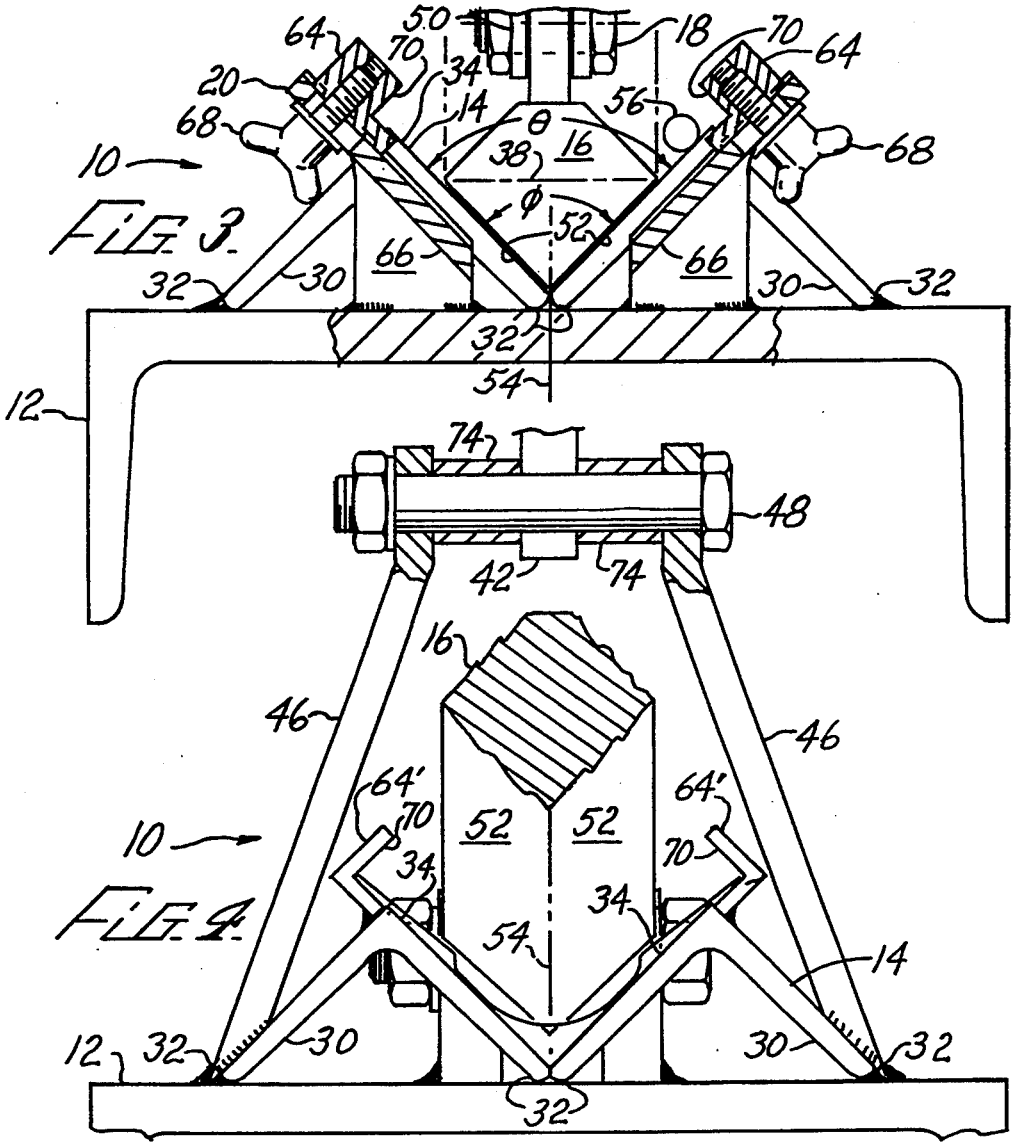
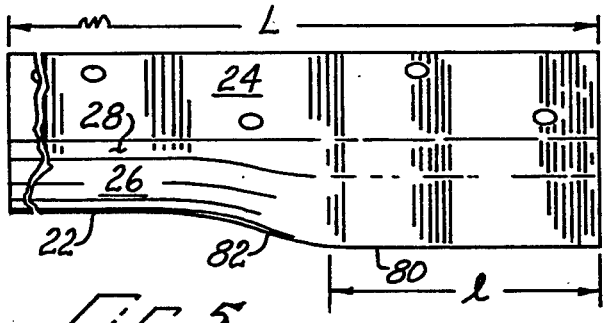
FIG. 5.
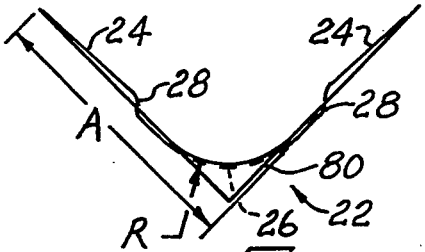
FIG. 6.
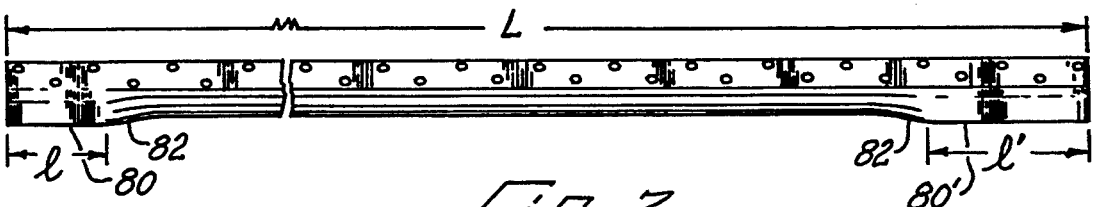
FIG. 7.

APPARATUS AND METHOD FOR FORMING BULLNOSE CORNER BEAD

BACKGROUND

The present invention relates to building construction wherein corner bead is used for forming smooth transition contours between plaster and plasterboard wall surfaces, and more particularly to facilitating the use of "bullnose" beading having relative large convex corner radii together with base and/or crown molding at floor and ceiling extremities of the corner bead and like features that are inconvenient or impractical in combination with typical bullnose corner radii.

Bullnose corner beading, popularly used at convex wall surface intersections in several styles of building construction, has a corner radius typically ranging from 0.5 inch to 0.75 inch, the corner radius subtending an angle of approximately 90°, and flanges extending in slightly offset relation to opposite extremities of the corner contour surface. The beading is usually nailed through the flanges against intersecting wallboard surfaces, and a plaster-like material is trawled over the flanges for creating smoothly finished surfaces extending from the wallboard to the respective extremities of the corner contour surface, the beading providing trawling guides along the contour surface extremities.

The large corner radius of bullnose beading makes application of molding strips such as base and crown molding particularly difficult in that the molding, being rigid or nearly so, cannot be formed to follow the contour of the corner bead, and without such forming, a large gap is created between the beading and the molding. There have been attempts to facilitate forming conventional wooden base and crown molding to follow the bullnose contour by cutting skarfs across the grain from the back side of the molding. The resulting appearance is unsatisfactory, not only because the skarfs penetrate through contoured portions of the molding, but also because pieces of the molding split from the strip when it is nailed in place.

Attempted solutions to these problems have been unsatisfactory for a number of reasons. In one example of the prior art, end portions of the corner bead are molded as separate pieces of plastic, having a transition contour to a plain angle profile and a portion having the plain angle configuration for extending under the base or crown molding. However, the resulting joint between the separate plastic pieces and the main bullnose section is unsightly, being impossible to hide completely, even with careful filling. Also, the molded pieces must either be made and stocked in different lengths to match the various base and crown moldings in use, or they must be cut to length on the job at added expense. A variation not having the plain angle portion is possible, but it is impractical to vertically locate the piece properly to butt against the molding, the molding being applied in a later stage of the construction.

Bullnose corner bead is also available as a single member having a plain angle end portion formed therein, the corner bead being supplied in oversize lengths for permitting the plain angle end portion to be trimmed to a suitable length for use with base molding, the opposite end of the corner bead also being trimmed for producing the required overall length. This scheme also has a number of disadvantages, for example:

1. The corner bead is significantly more expensive to provide than standard lengths having a uniform bullnose contour;

2. There is extra labor in cutting both ends of the corner bead;

3. There may be situations wherein the preformed plain angle end portion is too short; and 4. There is no provision for the use of both base and crown molding;

Thus there is a need for inexpensive bullnose corner bead that is compatible with both base and crown molding of variant widths.

SUMMARY

The present invention meets this need by providing a portable apparatus for inexpensively forming plain angle ends of bullnose corner beading on the job. In one aspect of the invention, the apparatus includes a base; an external die rigidly supported by the base and having planar surfaces intersecting at an exterior dihedral angle; a pair of retainer members extending within the dihedral angle in symmetrically spaced relation with the planar surfaces of the external die for holding the end portion of the corner bead with opposite leg extremities thereof in a laterally symmetric position relative to the external die, the corner bead contacting the planar surfaces thereof; an internal die member movably supported relative to the base for movement between open and closed positions in a plane bisecting the exterior dihedral angle, the internal die having planar surfaces intersecting an interior dihedral angle, the planar surfaces of the internal die being proximate the planar surfaces of the external die in the closed position for forming the end portion of the corner bead into the plain angular shape; and a driver for moving the internal die between the open and closed positions. The external dihedral angle can be approximately 90°, and the internal dihedral angle is approximately 90°.

Preferably the apparatus further includes a cradle rigidly supported relative to the base in spaced relation to the external die and in alignment therewith for supporting a portion of the corner bead during operation of the internal die. The retainer members can be primary retainer members that are located proximate the external die, the apparatus further including a pair of secondary retainer members located proximate the cradle for holding a portion of the corner bead on the cradle and aligned with the external die.

The driver can include an arm member pivotally mounted relative to the base, and a link pivotally connected between the arm member and the internal die. The internal die can be pivotally supported relative to the base on a die pivot axis.

Preferably the retainer members are adjustable relative to the external die for accommodating the corner bead having different flange widths, the retainer members being movable symmetrically relative to a dihedral apex of the external die member. The retainer members can be movable vertically relative to the base. The retainer members can be coupled for unison movement relative to the base.

In another aspect of the invention, a method for preparing wide flange bullnose corner bead in a predetermined length for use in building structures wherein at least one end portion of the corner bead is required to have a plain angular shape for a first distance from a corresponding end extremity of the corner bead, includes the steps of:

(a) providing a member of the corner bead having uniform bullnose cross-section in the predetermined length;

(b) supporting external leg portions of the end portion of the corner bead against an external die having planar surfaces intersecting at an external dihedral angle;

(c) retaining opposite leg extremities of the corner bead proximate the end portion in a laterally symmetric position relative to the external die;

(d) driving an internal die having planar surfaces intersecting at an interior dihedral angle in a direction bisecting the exterior dihedral angle into proximity with the exterior die whereby the planar surfaces of the interior die come into closely spaced relation to the external die over a predetermined distance not less than the first distance for forming the end portion of the corner bead.

The method can also include the steps of:

(a) providing a stop member for limiting the predetermined distance over which the internal die extends; and (b) before the step of driving the die, positioning the end extremity of the corner bead against the stop member.

The method can further include the steps of:

(a) providing a cradle rigidly spaced from the external die and in alignment therewith for supporting a portion of the corner bead;

(b) providing a pair of retainer members in alignment with opposite sides of the cradle; and (c) locating opposite leg extremities of the corner bead between the retainer members with the corner bead contacting the cradle for support of the corner bead in alignment with the external die.

DRAWINGS

These and other features, aspects, and advantages of the present invention will become better understood with reference to the following description, appended claims, and accompanying drawings, where:

FIG. 1 is a side elevational view of a corner bead forming apparatus according to the present invention;

FIG. 2 is a top plan view of the apparatus of FIG. 1;

FIG. 3 is a fragmentary sectional end view of the apparatus of FIG. 1;

FIG. 4 is a fragmentary sectional view as in FIG. 3, showing an alternative configuration of the apparatus of FIG. 1;

FIG. 5 is a side view of bullnose corner beading having one end thereof formed by the apparatus of FIG. 1;

FIG. 6 is an end view of the corner beading of FIG. 5;

FIG. 7 is a side view of corner beading having both ends formed by the apparatus of FIG. 1; and FIG. 8 is a lateral sectional elevational view showing another alternative configuration of FIG. 1.

DESCRIPTION

The present invention is directed to an apparatus and method for forming plain angle end portions of bullnose corner beading for use with base and/or corner moldings in building construction. With reference to FIGS. 1–3 and 5–7 of the drawings, a portable forming apparatus 10 includes a base 12, an external die 14 affixed to the base 12, an internal die 16 movably mounted to the base 12, a driver 18 for driving the internal die 16 into close proximity with the external die 14, and a retainer 20 for holding bullnose corner bead 22 aligned with the external die 14 during operation of the driver 18. The bullnose corner bead 22 is conventionally formed from thin sheet metal with flanges 24 extending approximately orthogonally from a central contoured portion 26, the contoured portion 26 having a relatively large corner radius R which is typically between 0.5 and 0.75 inch. The flanges 24 are offset inwardly by means of respective step portions 28 from the contoured portion 26 for permitting the application of a suitable filler (joint compound) after the corner bead 22 is nailed in place.

As best shown in FIG. 3, the base 12 is provided by a structural steel channel, the external die 14 being formed by a pair of 1.5 inch structural steel angles 30 that are welded at flange extremities 32 thereof to the base 12 for forming planar surfaces 34 at an external dihedral angle $\theta$ of approximately 90°. The internal die 16 is formed from a steel bar of generally 1 inch square cross-section that is pivotally mounted by a die bolt 36 on a die pivot axis 38, the bolt 36 protruding a pair of upstanding blocks 40 that are welded to the base 12 on opposite sides of the internal die 16 in spaced relation to the external die 14. The driver 18 includes a lever handle 42 that is pivotally mounted on a handle pivot axis 44 to a pair of handle support members 46 by a handle bolt 48, a link 50 also being pivotally connected between the handle 42 and the internal die 16 for movement thereof at high mechanical advantage between an open position as indicated by dashed lines in FIG. 1 and a closed position wherein planar surfaces 52 of the internal die 16 come into close proximity with the planar surfaces 34 of the external die 14 as indicated by solid lines in FIGS. 1 and 3.

As shown in FIG. 3, movement of the internal die 16 is generally in a die plane 54 bisecting the interior dihedral angle $\theta$, the planar surfaces 52 of the internal die 16 being inclined at an internal dihedral angle $\phi$ corresponding to the interior dihedral angle $\theta$, the angle $\phi$ also being approximately 90°. A stop bar 56 is adjustably supported relative to a stop block 58 that is fastened to the base 12, a thumb screw 60 threadingly engaging the block 58 for clamping the bar 56 as shown in FIG. 1 at a desired distance l from an opening extremity 62 of the external die 14 that also corresponds to a free end extremity of the external die 14 in the closed position thereof.

The retainer 20 forms an important feature of the present invention, including a pair of retainer members 64 that are symmetrically supported on opposite sides of the die plane 54 for holding the corner bead 22 centrally located in the external die 14 during movement of the internal die 16 toward the closed position. In an exemplary configuration of the forming apparatus 10, the retainer members 64 are adjustably mounted on ramp members 66 and clamped thereto by respective thumb screws 68. The ramp members 66 are formed from short sections of structural steel channel that are welded onto the base 12, a web portion of each channel having a shallow depression formed therein for guiding the retainer members 64 approximately parallel with a corresponding one of the planar surfaces 34 of the external die 14, a flange surface 70 of the retainer members 64 being aligned parallel with an apex of the external dihedral angle $\Theta$. The retainer members 64 are clamped symmetrically on opposite sides of the die plane 54 with the flange surfaces 70 equally spaced corresponding to a distance A by which the flanges 24 of the corner bead 22 project from opposite sides of the contoured portion 26 thereof as shown in FIG. 6.

An exemplary embodiment of the apparatus 10 also includes a cradle 72 mounted to the base 12 in spaced relation to the external die 14 for further support of the corner bead 22 as shown in FIGS. 1 and 2. The cradle 72 can be formed using counterparts of the structural angles 30, as a spaced apart extension of the external die 14. The exemplary forming apparatus 10 further includes counterparts of the retainer members 64 located in association with the cradle 72.

With further reference to FIG. 4, an alternative configuration of the apparatus 10 has counterparts of the retainer members, designated 64' fixably located on the external die 14. More particularly, the retainer members 64', in the form of small steel angle members, are welded onto the external die 14 along outside flanges of the respective structural angles 30. It will be understood that the cradle 72 can also be provided with the retainer members 64' of FIG. 4.

The handle support members 46, which can have the same form in the exemplary configuration of FIGS. 1–3 and the alternative configuration of FIG. 4, are welded to the structural angles 30, extending upwardly and inwardly from proximate opposite flange extremities 32 for avoiding excessive span length of the handle bolt 48, the bolt 48 being optionally provided with spacers 74 for centering the handle 42.

With further reference to FIG. 8, another alternative configuration of the forming apparatus 10 has the retainer members 64' on opposite sides of the die plane 54 rigidly connected on a vertically movable stage 76 that is adjustably positioned by a screw knob 78, the knob 78 threadingly engaging the stage 76. The rigid assembly of the retainer members 64' with the stage 76 advantageously accommodates the corner bead 22 in a variety of widths as defined by the flange extension A, in that the thin sheet metal of the corner bead 22 easily permits significant inward deflection of the flanges 24 for seating the corner bead 22 in various widths onto the cradle 72 by passing the flanges 24 downwardly between the retainer members 64'.

The retainer 20 having the adjustable configuration of FIG. 4 is ordinarily preferred whenever a particular unit of the apparatus 10 is required to be used with the corner bead 22 having more than one width A. The usual case, however, is that while the corner bead 22 is commercially supplied in different configurations, only a single configuration is likely to be encountered within the territory of a single crew of installers. Thus the retainer members 64 in the configuration of FIGS. 1–3 need adjustment only prior to a first use of the apparatus 10. Moreover, when a particular unit of the apparatus 10 is to be used only on the corner bead 22 having a known width A, the fixed retainer configuration of FIG. 4 is most advantageous. Adjustment of the retainer members 64 in the configuration of FIGS. 1–3 is facilitated by use of a jig in the form or a rigid counterpart of the corner bead 22.

FIGS. 5 and 6 show the corner bead 22 having been formed with a plain angle portion 80 having the length l by the forming apparatus 10. The forming effectively flattens the contoured portion 26 on opposite sides of the apex of the angle $\theta$, as well as the transition portion 28, coplanar with respective ones of the flanges 24. A transition contour 82 is also formed between the plain angle portion 80 and a main part of the corner bead 22 that is not modified by the apparatus 10.

With further reference to FIG. 7, the apparatus 10 is also effective for forming opposite ends of the corner bead 22 with counterparts of the plain angle portion 80, a second plain angle portion 80' being formed with a length l' for use with crown molding as needed in particular building construction.

The present invention provides a convenient and cost-effective apparatus and method for preparing bullnose corner beading for use with base and/or crown molding. The bullnose corner beading formed using the apparatus 10 as described herein is also effective at window sills for eliminating a corner radius cut that is conventionally required at intersections of bullnose corner bead segments.

Although the present invention has been described in considerable detail with reference to certain preferred versions thereof, other versions are possible. For example, The driver 18 can incorporate a cam in place of the link 50. Also, the retainer members 64 can be driven in unison along the ramp members 66 by respective lead screws that are geared together. Therefore, the spirit and scope of the appended claims should not necessarily be limited to the description of the preferred versions contained herein.

What is claimed is:

1. Apparatus for forming end portions of wide flange bullnose corner bead into a plain angular shape for a first distance from a corresponding end extremity of the corner bead, the corner bead being configured for use in building structures, the apparatus comprising:

(a) a base;

(b) an external die rigidly supported by the base, the external die having planar surfaces intersecting at an exterior dihedral angle;

(c) a pair of retainer members extending within the dihedral angle in symmetrically spaced relation with the planar surfaces of the external die for holding the end portion of the corner bead with opposite leg extremities thereof in a laterally symmetric position relative to the external die, the corner bead contacting the planar surfaces thereof;

(d) an internal die member movably supported relative to the base for movement between open and closed positions in a plane bisecting the exterior dihedral angle, the internal die having planar surfaces intersecting an interior dihedral angle, the planar surfaces of the internal die being proximate the planar surfaces of the external die in the closed position for forming the end portion of the corner bead into the plain angular shape; and (e) a driver for moving the internal die between the open and closed positions.

2. The apparatus of claim 1, wherein the external dihedral angle is approximately 90°.

3. The apparatus of claim 2, wherein the internal dihedral angle is approximately 90°.

4. The apparatus of claim 1, further comprising a stop member rigidly located relative to the base for providing a predetermined distance over which the internal die extends on the corner bead from the end extremity.

5. The apparatus of claim 1, further comprising a cradle rigidly supported relative to the base in spaced relation to the external die and in alignment therewith for supporting a portion of the corner bead during operation of the internal die.

6. The apparatus of claim 5, wherein the retainer members are primary retainer members, the primary retainer members being located proximate the external die, the apparatus further comprising a pair of secondary retainer members located proximate the cradle for holding a portion of the corner bead on the cradle and aligned with the external die.

7. The apparatus of claim 1, wherein the driver comprises an arm member pivotally mounted relative to the base, and a link pivotally connected between the arm member and the internal die.

8. The apparatus of claim 1, wherein the internal die is pivotally supported relative to the base on a die pivot axis.

9. The apparatus of claim 1, wherein the retainer members are adjustable relative to the external die for accommodating the corner bead having different flange widths, the retainer members being movable symmetrically relative to a dihedral apex of the external die member.

10. The apparatus of claim 9, wherein the retainer members are movable vertically relative to the base.

11. The apparatus of claim 9, wherein the retainer members are coupled for unison movement relative to the base.

12. Apparatus for forming end portions of wide flange bullnose corner bead into a plain angular shape for a first distance from a corresponding end extremity of the corner bead, the corner bead being configured for use in building structures, the apparatus comprising:

(a) a base;

(b) an external die rigidly supported by the base, the external die having planar surfaces intersecting at an exterior dihedral angle of approximately 90°;

(c) a pair of retainer members extending within the dihedral angle in symmetrically spaced relation with the planar surfaces of the external die for holding the end portion of the corner bead with opposite leg extremities thereof in a laterally symmetric position relative to the external die, the corner bead contacting the planar surfaces thereof;

(d) an internal die member pivotally supported relative to the base on a die pivot axis for movement between open and closed positions in a plane bisecting the exterior dihedral angle, the internal die having planar surfaces intersecting an internal dihedral angle of approximately 90°, the planar surfaces of the internal die being proximate the planar surfaces of the external die in the closed position for forming the end portion of the corner bead into the plain angular shape;

(e) a driver for moving the internal die between the open and closed positions, the driver comprising an arm member pivotally mounted relative to the base, and a link pivotally connected between the arm member and the internal die;

(f) a stop member rigidly located relative to the base for providing a predetermined distance over which the internal die extends on the corner bead from the end extremity.

13. A method for preparing wide flange bullnose corner bead in a predetermined length for use in building structures wherein at least one end portion of the corner bead is required to have a plain angular shape for a first distance from a corresponding end extremity of the corner bead, comprising the steps of:

(a) providing a member of the corner bead having uniform bullnose cross-section in the predetermined length;

(b) supporting external leg portions of the end portion of the corner bead against an external die having planar surfaces intersecting at an external dihedral angle;

(c) retaining opposite leg extremities of the corner bead proximate the end portion in a laterally symmetric position relative to the external die; and (d) driving an internal die having planar surfaces intersecting at an interior dihedral angle in a direction bisecting the exterior dihedral angle into proximity with the exterior die whereby the planar surfaces of the interior die come into closely spaced relation to the external die over a predetermined distance not less than the first distance for forming the end portion of the corner bead.

14. The method of claim 13, including the further steps of:

(a) providing a stop member for limiting the predetermined distance over which the internal die extends; and (b) before the step of driving the die, positioning the end extremity of the corner bead against the stop member.

15. The method of claim 13, including the further steps of:

(a) providing a cradle rigidly spaced from the external die and in alignment therewith for supporting a portion of the corner bead;

(b) providing a pair of retainer members in alignment with opposite sides of the cradle; and (c) locating opposite leg extremities of the corner bead between the retainer members with the corner bead contacting the cradle for support of the corner bead in alignment with the external die.

16. The method of claim 13, wherein the external dihedral angle is approximately 90°.

17. The method of claim 16, wherein the internal dihedral angle is approximately 90°.

* * * * *